United States Patent [19]

Gazzarrini

[11] 4,376,400

[45] Mar. 15, 1983

[54] IMPROVEMENTS IN A MACHINE FOR APPLYING A GUSSET TO TUBULAR ARTICLES SUCH AS WOMEN'S PANTYHOSE

[75] Inventor: Vinicio Gazzarrini, Tavarnuzze, Italy

[73] Assignee: Solis s.r.l., Florence, Italy

[21] Appl. No.: 162,166

[22] Filed: Jun. 23, 1980

[30] Foreign Application Priority Data

Jun. 22, 1979 [IT] Italy ..... 9462 A/79

[51] Int. Cl.[3] ..... B26D 5/20

[52] U.S. Cl. ..... 83/109; 83/112; 83/153; 83/162; 83/236; 83/276; 83/277

[58] Field of Search ..... 226/162–166; 83/152, 236, 277, 276, 488, 489, 276, 109, 153, 112

[56] References Cited

U.S. PATENT DOCUMENTS

| | | | |
|---|---|---|---|
| 342,127 | 5/1886 | Panyard | 83/489 X |
| 2,755,085 | 7/1956 | Giani | 226/162 X |
| 2,823,749 | 2/1958 | Chamberlain | 83/489 X |
| 3,052,143 | 9/1962 | Cooley | 83/277 X |
| 3,212,380 | 10/1965 | Gobel et al. | 83/277 X |
| 3,458,381 | 7/1969 | Metcalfe | 83/277 X |
| 3,538,800 | 11/1970 | Pshenichny et al. | 83/153 |
| 3,599,521 | 8/1971 | Lee | 83/236 X |
| 3,703,066 | 11/1972 | Marion et al. | 83/277 X |
| 3,991,926 | 11/1976 | Marks | 83/153 X |
| 4,212,217 | 7/1980 | Heppnel | 83/277 |

FOREIGN PATENT DOCUMENTS

| | | | |
|---|---|---|---|
| 659758 | 5/1938 | Fed. Rep. of Germany | 83/153 X |

*Primary Examiner*—James M. Meister

*Attorney, Agent, or Firm*—McAulay, Fields, Fisher, Goldstein & Nissen

[57] ABSTRACT

A device is provided for feeding a continuous fabric web to a machine for sewing women's pantyhose. The continuous fabric web is formed into a gusset for the pantyhose by various devices including a motor controlled by a photoelectric device for feeding the fabric web from a spool of fabric web. A carriage alternately moves in a horizontal direction and has several web pulling jaws to pull the web into place. A tampon pincer projects from the plane of operation to hold the fabric web tight. Thereafter, a pair of co-acting blades cuts and trims the web and the pantyhose material. The pantyhose material and formed gusset are held taut until they can be sewn together.

9 Claims, 9 Drawing Figures

IMPROVEMENTS IN A MACHINE FOR APPLYING A GUSSET TO TUBULAR ARTICLES SUCH AS WOMEN'S PANTYHOSE

BACKGROUND OF THE INVENTION

Reference is hereby made to U.S. applications: Ser. No. 55,261 filed July 6, 1979; Ser. No. 107,426 filed Dec. 26, 1979, and Ser. No. 119,130 filed Feb. 6, 1980, all by the same inventor hereof.

Described in these patent applications is a machine for applying a gusset especially of circular form, to a tubular article, and especially a pantyhose made separately, but without seam in the crotch zone. For the prior machine such as described in U.S. Ser. No. 107,426, special means for the formation and feeding of the gussets have not been described, and neither have special means for the trimming, with respect to the seam line, the article and of the gusset, which are superposed before being sewn.

The present invention relates to some improvements in the machine for applying gussets which concern both the means for forming the gussets from a continuous web and for transferring them onto the gusset-carrying plates, as well as to means for the trimming cut of the patches and of the articles brought together before they are sewn.

These improvements have been specially designed to obtain greater precision of execution and a greater hourly output of the machine which was the subject of the prior applications.

BRIEF DESCRIPTION OF THE DISCLOSURE

A device is provided for feeding a continuous fabric web to a machine for sewing women's pantyhose. The continuous fabric web is formed into a gusset for the pantyhose by various devices including a motor controlled by a photoelectric device for feeding the fabric web from a spool of fabric web. A carriage alternately moves in a horizontal direction and has several web pulling jaws to pull the web into place. A tampon pincer projects from the plane of operation to hold the fabric web tight. Thereafter, a pair of co-acting blades cuts and trims the web and the pantyhose material. The pantyhose material and formed gusset are held taut until they can be sewn together.

BRIEF DESCRIPTION OF THE DRAWINGS

Further advantages and characteristics of these improvements will be better understood by any technician in the field from the description which follows and from the annexed drawings, where.

DESCRIPTION OF THE PREFERRED EMBODIMENT

Figure 1:
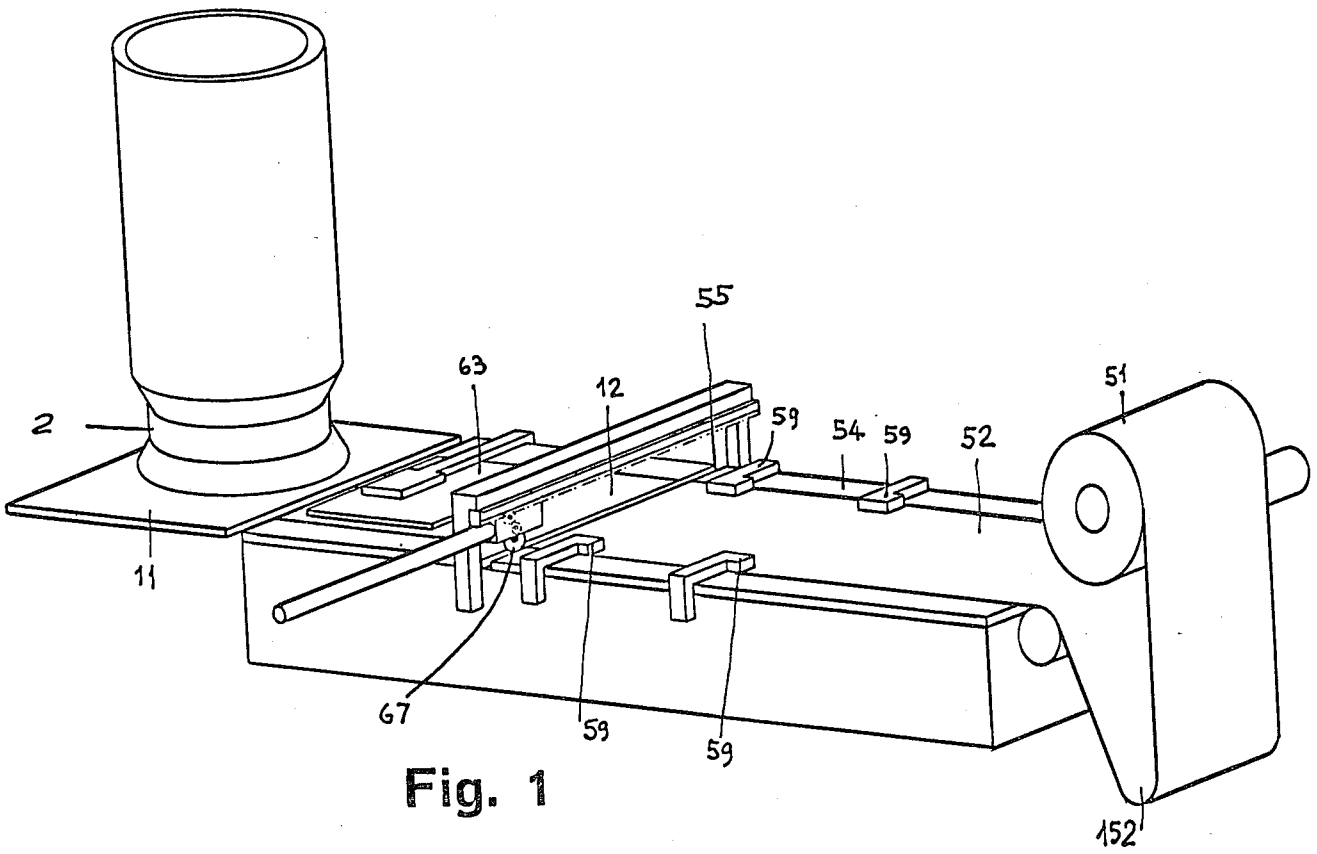
FIG. 1 shows, in axonometric overall view, the means for the formation of the gussets from a continuous web and for their transfer onto gusset-carrying plates of a machine of the type described in said U.S. application Ser. No. 107,426.
Figure 2:
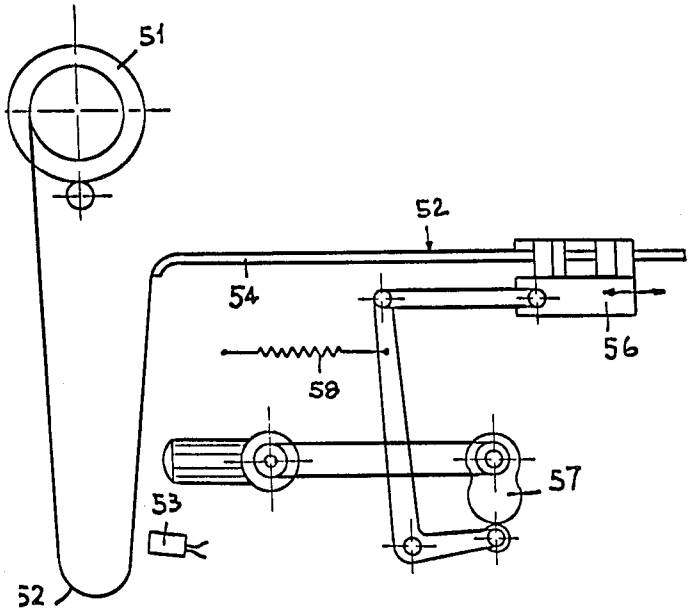
FIG. 2 shows the detail of the mechanism for the alternating motion of the carriage carrying the means for the intermittent advance of the web for the gussets.
Figure 3:
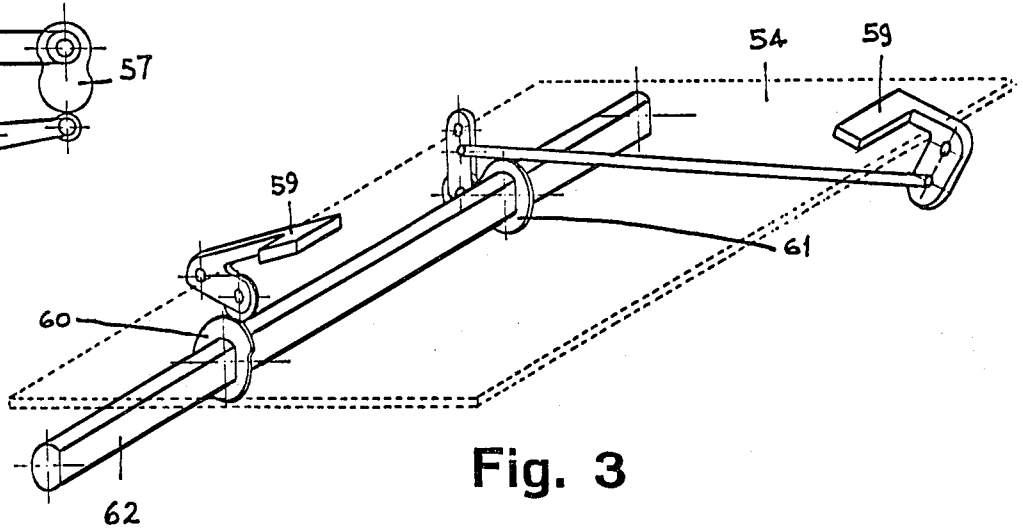
FIG. 3 shows the detail of the means for the intermittent advance of the web for the gussets.
Figure 5:
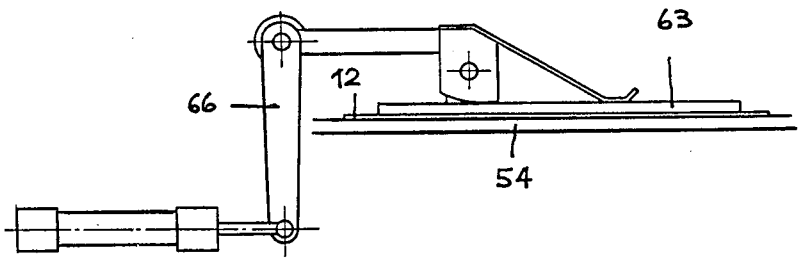
FIG. 5 represents the detail of the means for opening and closing said pincer or clamp.
Figure 5:
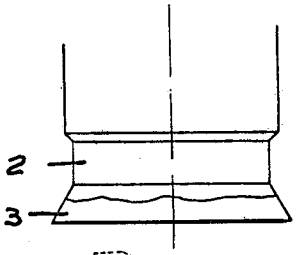
Figure 6:
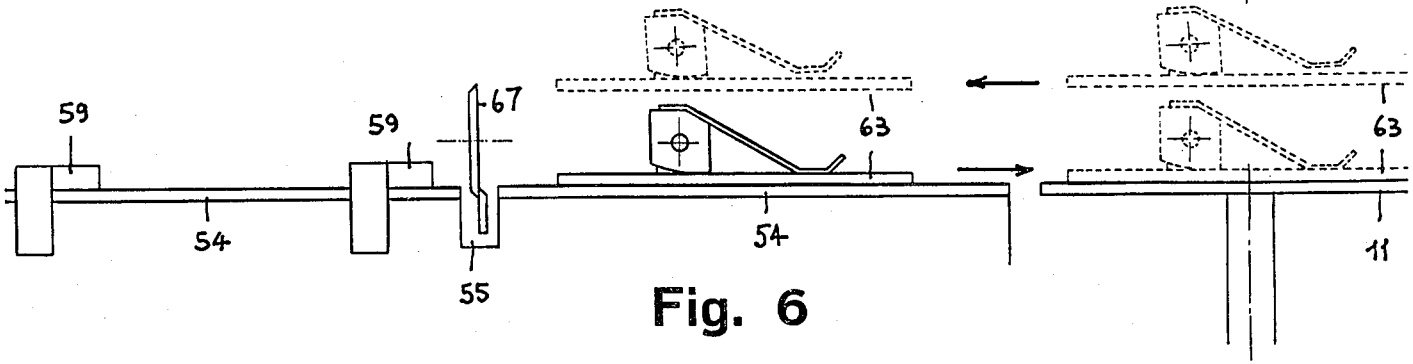
FIG. 6 represents the detail of the positions assumed by said pincer or clamp in the active (lower) stroke and in the return (upper)
Figure 4:
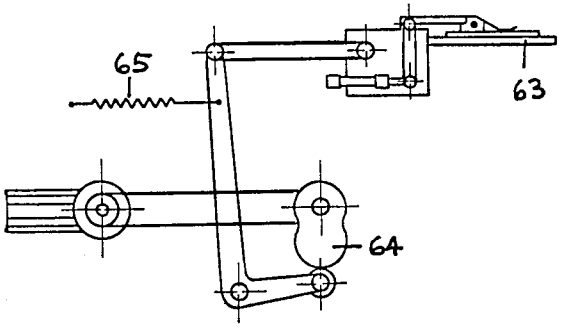
FIG. 4 represents the detail of the mechanism for the alternating motion of the pincer or clamp for the transfer of the gussets onto the gusset-carrying plates.
Figure 7:
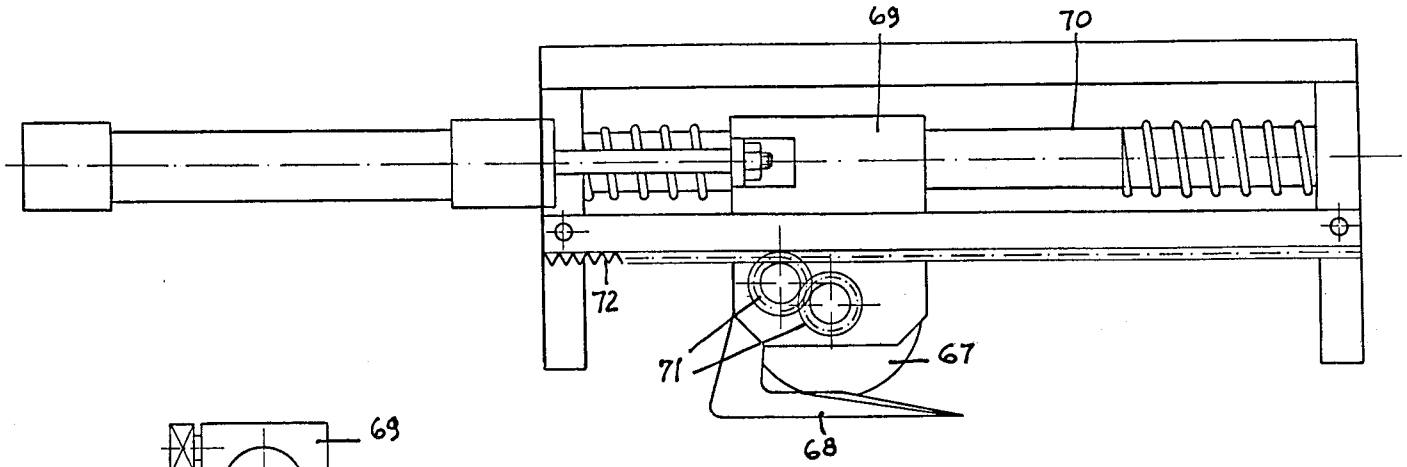
FIG. 7 represents the front view of the detail of the shear for forming the gussets.
Figure 8:
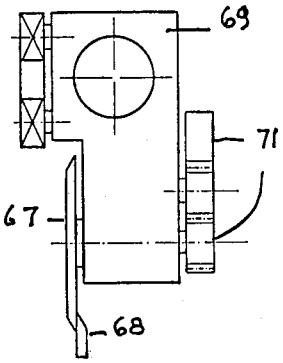
FIG. 8 represents the side view of said shear.

More particularly and with reference to FIGS. 1 to 8 of the annexed drawings, the means for the formation of the gussets from a continuous web and for their transfer onto gusset-carrying plates (11) such as the plates (11) described in conjunction with machines described in the above referenced earlier applications comprise: a spool (51) for the web (52) whose intermittent unwinding, obtained by means of an electric motor controlled by a photo-cell (53), causes the formation of a loop (152) in cascade, so as to avoid excessive tensioning of the leading end of the web on the cutting plane; a horizontal plane (54) on which the leading end of the web (52) is laid, provided with a transverse groove (55) at the web cutting zone; a carriage (56) carrying several web-pulling jaws (59), having alternating horizontal motion, the active stroke of which generated by a mechanism (57) and the return stroke of which generated by a spring (58), said web-pulling jaws (59) being disposed above the longitudinal edges of the web-laying plane (54) and subject to two mechanisms (60-61) controlled by a single grooved shaft (62) which causes the vertical rotation thereof with opening and closing of the plane (54) of the web and with the interposition of the leading end of the web (52); a patch-pressing tampon pincer or clamp (63), projecting from said plane (54) and given alternating horizontal motion by a mechanism (64) for its active stroke of transfer of one gusset (12) at a time from the laying plane (54) to a gusset-carrying plate (11), and having return spring (65) for its idle return stroke, and further given an oscillatory motion with respect to the plane (54) and for this subjected to a lever system (66) which causes the opening thereof at end of forward stroke and its closing at end of return stroke, thereby obtaining, respectively, the release of the gusset (12) already transferred to the gusset-carrying plate (11) and compression of the free end of the leading end of the web (52) before the cutting for the formation of the gusset, a shear with circular blade (67) with counter-blade (68) whose support (69) is controlled by known means so as to be translating in horizontal direction alternately, on a guide (70) projecting transversely to the laying plane (54) of the web (52), a gearing (71) engaging the shaft of the blade (67) at a rack (72) for assuring the rotation thereof during the translation of the support (69).

The above described means are preferably provided at an appropriate position along the operating line of a gusset sewing machine. The operation is the following. Whenever one of the supports carrying the pantyhose to be gusseted stops at the above described device and the gusset-carrying plate (11) is opposite and coplanar with the head of the plane (54) on which the web (52) rests, the pincer (63) advances transferring the patch (12) previously cut by the blade (67), onto said plate (11); here the pincer (63) opens, letting go of the gusset (12) and in that position moves back; at end of return stroke the pincer (63) closes on the free end of the trailing end of the web (52) advanced by the jaws (59) by a quantity equal to the length of the gusset; whereupon the jaws (50) open and in that position move back at the end of stroke close again on the web (52); whereupon the shear makes the cut, while the web is held fast by the jaws (59) and by the pincer (63).

Figure 9:
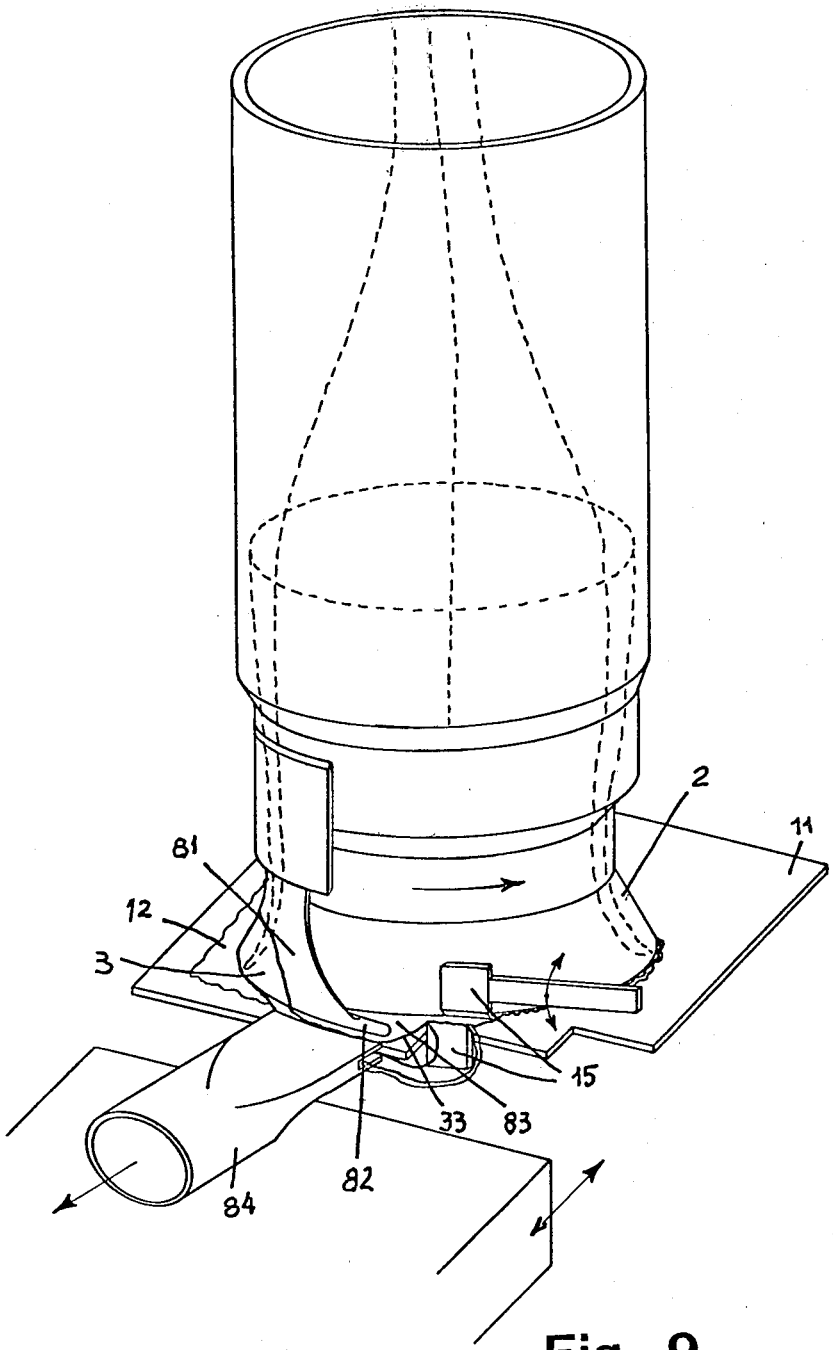
FIG. 9 represents the detail of the means for trimming the article and the gusset brought together in superposition before they are sewn.

With regard to the means for allowing the trimming cut of the patch and of the article before their being sewn, and with reference to FIG. 9 of the annexed drawings, they comprise: an outer lamellar element (81) juxtaposed to a base portion of the support (2) but independent thereof, one end of said element (81) being tangential to the support (2) and the other (82) being spaced therefrom and of small height so as to define a clearance (83) between the end (82) and the base of the support (2) so to obtain in the edge of the article (3) arranged stretched on said support (2), a short rectilinear section (33) which is quite taut and strongly inclined relative to the tangent to said support (2) and to the cutting plane of the blades (15) and therefore such as to be easily cut by the blades (15); a suction duct (84), whose mouth is advantageously tapered, to obtain the removal of the fabric portions external to the sewing line cut by the blades (15) during the rotation of the support (2) and further to obtain the spreading of the fabric in the cutting zone; and known for moving the blades (15) and said duct (84) away from and toward the support (2).

The above described means are used in the next adjacent station to that where the above device is located.

In the practice the particulars of execution may vary in equivalent manner as to form, dimensions, arrangement of the elements, nature of the materials employed, without going outside the scope of the ideas of solution adopted and therefore remaining within the limits of the protection granted by the present patent of invention.

I claim:

1. Device for the formation and feeding of a gusset from a continuous spool of fabric web, in a machine including a gusset carrying plate for applying a gusset to a tubular article such as a woman's pantyhose, comprising:

a web receiving means including a fixed work support having a horizontal plane for receiving the leading end of the fabric web taken from its spool, said fixed work support having a transverse groove therein;

means for intermittently unwinding the fabric web including an electric motor, and a photocell device operable to control said motor, to unwind the fabric web to form a loop of fabric in cascade;

disposed upstream of said plane, a web handling means including a carriage operable for alternate horizontal motion and carrying several web-pulling jaws projecting from said plane at the longitudinal edges of the web feed path and oscillating relative to the plane;

said web-pulling jaws pressing the upper side of the fabric web onto said horizontal plane of said fixed work support and moving the fabric web therealong;

a tampon pincer projecting from said plane, and operable for alternate horizontal motion and oscillating relative to the plane for transferring each gusset formed from the web onto the gusset-carrying plate of the machine;

a shear with circular blade and counter-blade movable transversely on said plane and with partial penetration into said transverse groove; and whereby during the cutting of the web for the formation of the gussets, it is pressed onto the plane by the jaws and tampon pincer.

2. The device of claim 1, wherein said carriage is moved by the opposed operation of a carriage moving mechanism and a return spring, the stroke of said carriage being of predetermined length equal to the length of the gussets to be obtained; said jaws being operated by two mechanisms controlled by a grooved shaft which causes the opening thereof during the return stroke and the closing before the cutting of the web for the formation of a gusset and during the forward stroke of the web.

3. The device of claim 1, wherein said tampon pincer is operated, for the alternating rectilinear motion, by a tampon operating mechanism and a return spring, and for the motion of oscillation relative to the plane it is operated by a lever system which lets the gusset be released at the end of the forward stroke of a pincer and allows compressing the end of the leading end of the web at end of return stroke of the pincer.

4. The device of claim 1, wherein said shear includes a rack, and gearing, the shaft of said blade being in engagement with said rack which is moved by said gearing to rotate said blade during the translation.

5. Device for the formation and feeding of a gusset from a continuous spool of fabric web in a machine which includes a gusset carrying plate to apply the gusset to a tubular article, comprising:

web receiving means for receiving the leading end of the fabric web taken from the continuous spool and for maintaining the portion of the fabric web between the continuous spool and the leading end of the fabric web in an approximately horizontal condition;

said web means including fixed work support means having a transverse groove therein;

means for intermittently unwinding the fabric including transport means and sensing means operable to control said sensing means for forming a loop of fabric in cascade;

web handling means positioned upstream of said web receiving means including means operable for alternate horizontal motion and carrying web-pulling transfer means projecting from said web receiving means and oscillating relative thereto for transferring each gusset formed from the web onto said gusset-carrying plate;

web-pulling jaws means pressing the upper side of the fabric web onto said fixed work support means and thereafter moving the fabric along said fixed work support means;

shear means including cooperating blades, one of said cooperating blades being movable transversely on said web-receiving means with partial penetration in said transverse groove, whereby the web during the cutting thereof for the formation of the gussets is pressed onto said web handling means by said jaw means in cooperation with said web handling means.

6. The device of claim 5, wherein said web handling means includes a carriage movable by the opposed operation of a carriage moving mechanism and a return spring, a forward stroke of said carriage being of predetermined length equal to the length of the gussets to be obtained; and said jaw means being operated by two mechanisms controlled by a grooved shaft which causes the opening thereof during a return stroke and the closing before the cutting of the web for the formation of said gusset and during the forward stroke of said web.

7. The device of claim 5, wherein said web handling means includes tampon pincer means operable for alternating rectilinear horizontal and oscillating motion, projecting from said web receiving means by a tampon means operating mechanism and a return spring, and for the motion of oscillation relative to a plane forming part of said web receiving means it is operated by a lever system which provides for the gusset to be released at the end of the forward stroke of said pincer means and allows compressing the end of the leading end of the web at end of return stroke of said pincer means.

8. In apparatus for the formation and feeding of a gusset from a continuous spool of fabric web including:

a gusset carrying plate for applying a gusset to a tubular article such as a woman's pantyhose;

a web-receiving means including a horizontal plane on a stationary work support for receiving the leading end of said fabric web taken from said spool;

means for intermittently unwinding said fabric web including an electric motor, and a photocell device operable to control said motor, to unwind said fabric web to form a loop of fabric in cascade;

disposed upstream of said plane, a web handling means including a carriage operable for alternate horizontal motion, a tampon pincer projecting from said plane, and operable for alternate horizontal motion and oscillating relative to the plane for transferring each gusset formed from said web onto a gusset-carrying plate of the machine; a shear with circular blade and counter-blade movable transversely on said plane and with partial penetration into a transverse groove in said support;

the improvement consisting of:

said carriage carrying web-pulling jaws above the longitudinal edges of the web feed path and oscillating relative to said plane;

said jaws pressing the upper side of the fabric web onto said stationary work support and thereafter moving the fabric along said fixed work support;

said carriage being moved by the opposed operation of a carriage moving mechanism and a return spring, the stroke of said carriage being of predetermined length equal to the length of the gusset to be obtained; and said jaws being operated by two mechanisms controlled by a grooved shaft which causes the opening thereof during the return stroke and closing before the cutting of said web for the formation of a gusset and during the forward stroke of the web, whereby said web is moved on said plane by pressure applied from above by said jaws during horizontal movement of said jaws.

9. A device for cutting a fabric part next to a sewing line of a tubular article such as a pantyhose and of a gusset to be applied to the pantyhose before the gusset and the pantyhose are sewn together in a machine for applying the gusset to the pantyhose, comprising:

a mechanism for the formation and feeding of said gusset from a continuous spool of fabric web in the machine, said machine including a gusset-carrying plate for applying said gusset to the pantyhose;

said mechanism comprising web-handling means including a carriage operable for alternate horizontal motion and carrying several web-pulling jaws projecting from a plane, said web means including a stationary work support forming said plane and having a transverse groove in the web cutting zone thereof at the longitudinal edges of a web feed path and oscillating relative to said plane for receiving the leading end of the fabric web as it is removed from its said continuous spool;

tampon pincer means projecting from said plane, and operable for alternate horizontal motion and oscillating relative to the plane for transferring each gusset formed from the web onto said gusset-carrying plate of the machine;

the improvement consisting of:

web-pulling jaw means pressing the upper side of the fabric onto said fixed work support means; and a shear with a circular blade above said path and a counter-blade below said path movable transversely on said plane and with partial penetration into said groove, whereby net and reliable cutting of said web for the formation of said gusset is obtained.

* * * * *